US005576277A

United States Patent [19]

MacBeath et al.

[11] Patent Number: 5,576,277

[45] Date of Patent: Nov. 19, 1996

[54] GRANULAR DETERGENT COMPOSITIONS

[75] Inventors: Fiona S. MacBeath; Suzanne Powell, both of Gosforth, Great Britain

[73] Assignee: The Procter & Gamble Company, Cincinnati, Ohio

[21] Appl. No.: 295,892

[22] PCT Filed: Mar. 5, 1993

[86] PCT No.: PCT/US93/01897

§ 371 Date: Sep. 8, 1994

§ 102(e) Date: Sep. 8, 1994

[87] PCT Pub. No.: WO93/18124

PCT Pub. Date: Sep. 16, 1993

[30] Foreign Application Priority Data

Mar. 10, 1992 [GB] United Kingdom ..... 9205189

[51] Int. Cl.[6] ..... C11D 1/52; C11D 1/83; C11D 1/28; C11D 3/32

[52] U.S. Cl. ..... 510/113; 510/224; 510/228

[58] Field of Search ..... 252/174, 550, 252/551, 554, 557, 558, 548, 174.23

[56] References Cited

U.S. PATENT DOCUMENTS

| | | | |
|---|---|---|---|
| 2,703,798 | 3/1955 | Schwartz | 260/211 |
| 3,960,780 | 6/1976 | Murata et al. | 252/532 |
| 4,019,999 | 4/1977 | Ohren et al. | 252/140 |
| 4,140,657 | 2/1979 | Okumura et al. | 252/551 |
| 4,487,710 | 12/1984 | Kaminsky | 252/546 |
| 5,332,528 | 7/1994 | Pan et al. | 252/548 |
| 5,445,755 | 8/1995 | Convents et al. | 252/102 |
| 5,454,982 | 10/1995 | Murch et al. | 252/548 |
| 5,482,642 | 1/1996 | Agar et al. | 252/90 |

*Primary Examiner*—Paul Lieberman
*Assistant Examiner*—Necholus Ogden
*Attorney, Agent, or Firm*—Ken K. Patel; Jacobus C. Rasser; Jerry J. Yetter

[57] ABSTRACT

Granular detergent compositions of density >55 g/liter are provided comprising a plurality of particulate components, wherein one or more surfactant-containing particulate components comprise a surfactant system consisting essentially of one or more primary anionic or nonionic surfactants in intimate admixture with a water-soluble $C_{11}$–$C_{18}$ alkyl ethoxysulfate salt containing an average of from one to seven ethoxy groups per mole, together with a builder system. The weight ratio of the primary anionic or nonionic surfactants or mixtures thereof to the alkyl ethoxysulfate salt is in the range from 19:1 to 2:1 provided that the level of the alkyl ethoxysulfate salt is from 0.25% to 10% by weight of the component. Improved rate of dissolution characteristics are observed for the composition and for the individual particulate components containing said surfactant system.

14 Claims, 4 Drawing Sheets

Fig. 1

GRANULAR DETERGENT COMPOSITIONS

Figure 1:
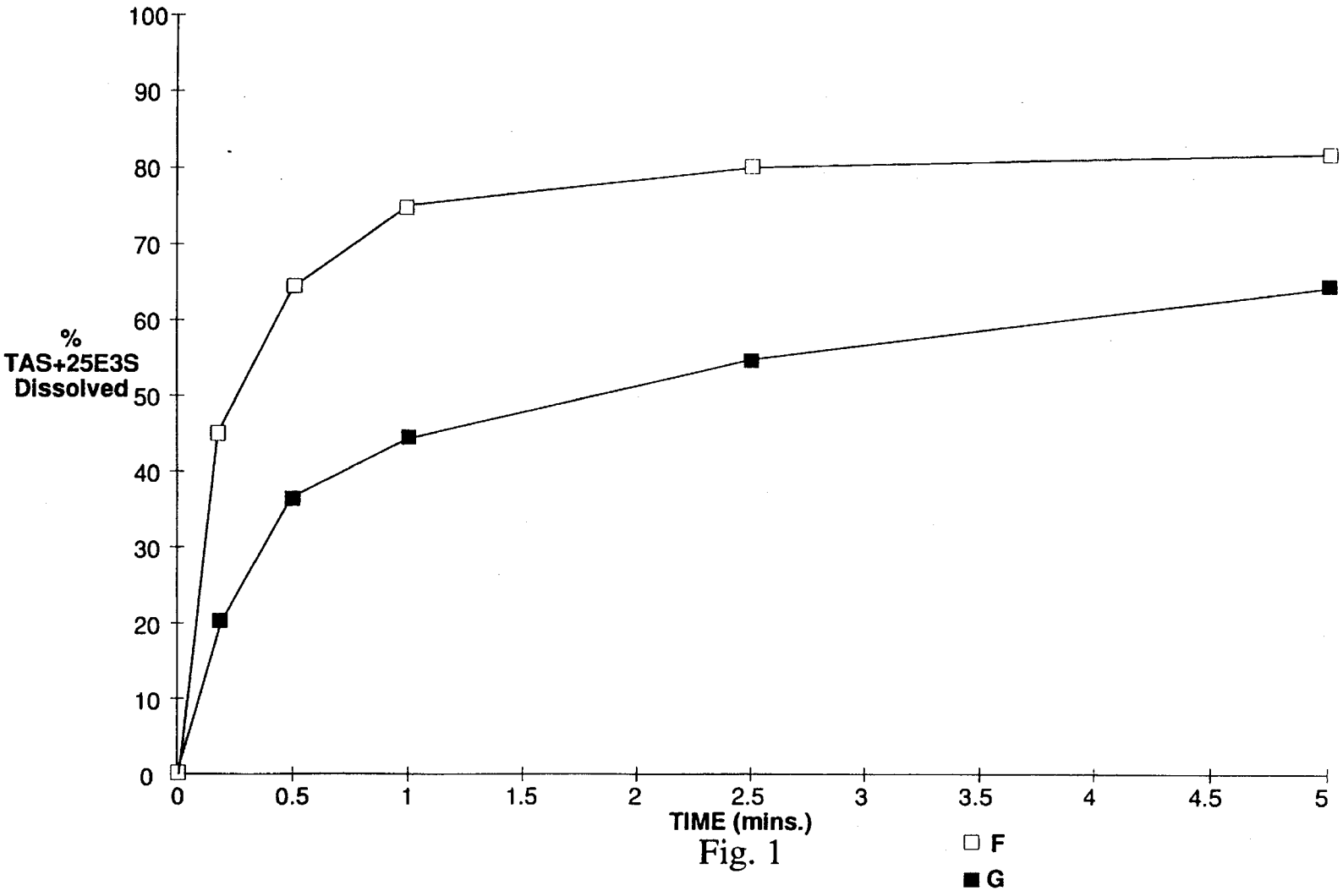

This invention relates to detergent compositions for fabric cleaning and more especially to high density granular detergent compositions comprising one or more surfactant-containing particulate components.

Granular detergent compositions containing linear alkyl benzene sulfonate salts are well known in the art and are in widespread commercial use. Conventionally the linear alkyl benzene sulfonate salt forms part of a surfactant mixture in association with one or more other anionic or nonionic surfactants. The former dissolves readily in water over a wide range of temperatures and, at ambient i.e. cool water temperature may aid solubilisation of any of the other anionic or nonionic surfactants which are relatively water-insoluble.

Concern has recently been expressed over the fate of linear alkyl benzene sulfonates and their biodegradation products in the environment. Of particular concern is the persistence in surface water of certain di-alkyl tetralin compounds which are found as impurities in commercial supplies of linear alkyl benzene sulfonates. Interest has therefore increased in the use of alternatives to alkyl benzene sulfonates as major components of detergent products.

Examples of primary anionic or nonionic surfactants that are readily biodegradable and which could replace the alkyl benzene sulfonate component either partially or in toto include alkyl sulfate salts, alkane sulfonate salts, alkyl methyl ester sulfonate salts and polyhydroxy fatty acid amides. However, where the alkyl benzene sulfonate forms part of a mixture with such primary anionic or nonionic surfactants in a granular component of a high density detergent composition, its removal gives rise to a major change in the physical properties of that granular component. The principal effect is to make the granule hydrophobic in character, with a consequential decrease in its rate of dissolution, particularly in water of temperatures <40° C.

This hydrophobicity can be utilised to advantage where the granule forms part of a laundry detergent product introduced into an automatic washing machine through a dispensing drawer, and the commonly assigned copending European Application Publication No. 0342043 seeks protection for a product having such characteristics.

However, the excessive hydrophobicity of any granular components has been found to lead to unacceptable dissolution characteristics for a concentrated high-density detergent product, i.e. one of density >550 g/liter, containing such components as a significant fraction. Concentrated products of this type are typically introduced into the drum of the washing machine via a dispensing device and excessive hydrophobicity leads to product residues remaining on fabrics or in the dispensing device at the end of the wash cycle.

The use of such a dispensing device provides transient localised high concentrations of detergent product in the drum of an automatic washing machine at the start of the wash cycle. Such high transient concentrations have been shown to provide fabric cleaning benefits. To achieve these high transient concentrations rapid dissolution/dispersion of the detergent product is required. Unacceptable dissolution characteristics associated with the excessive hydrophobicity of any granular components will prevent achievement of these required high transient concentrations and therefore lead to a loss in fabric cleaning benefits.

Where the primary anionic surfactant is $C_{14}$–$C_{20}$ alkyl sulfate salt incorporation of alkyl sulfate salts of shorter chain length does not provide an acceptable solution to the problem of excessive hydrophobicity of the granular components, particularly where the $C_{14}$–$C_{20}$ alkyl sulfate salt-containing component is a spray dried powder. This is because alkyl sulfate salts contain an appreciable level of unsulfated material and the spray drying of powders having an alkyl sulfate salt-content >5% gives rise to significant levels of the volatilised unsulfated material in the spray drying gases which cause safety and environmental discharge problems. These problems may be only partially alleviated by the attachment of filters to the top of the spray drying towers.

The Applicant has however found an alternative solution to the problem of the poor dissolution characteristics associated with the excessive hydrophobicity of the particulate components, which has no negative environmental or safety consequences. Introduction of a low level of water soluble ethoxylated alkyl sulfate such that it is in intimate admixture with the primary anionic or nonionic surfactant in a surfactant-containing particulate component provides improved dissolution characteristics for that particulate component. In particular, the rate of dissolution increases.

This improvement of dissolution characteristics was unexpected as ethoxylated short chain alkyl sulfates were not known to be effective solubilising agents, particularly when present at low levels, and were also not thought to have acceptable stability under the temperature conditions arising during a spray drying process.

There is interest in the development of detergent compositions which include a surfactant system comprising only low levels (eg: 5% to 10% by weight) of anionic surfactant. One disadvantage of formulating such compositions is that detergency performance may be impaired by the large degree of complexation of the low level of anionic surfactants by any cationic fabric softener components which may be present in the wash solution. Such cationic fabric softener components may be introduced into the wash solution as residues on the fabrics to be washed, particularly where the fabrics have in a previous wash been treated with a fabric conditioning composition containing such cationic softener components.

The Applicant has found surprisingly robust detergency performance for a detergent composition comprising low levels of water soluble alkyl ethoxysulfate and alkyl sulfate in combination at specific weight ratios, even in the presence of cationic fabric softener components in the wash solution. By low levels of water soluble alkyl ethoxysulfate and alkyl sulfate it is meant levels of from 5% to 10% combined weight of these surfactants.

According to one aspect of the present invention there is provided a granular detergent composition having a density greater than 550 g/liter and formed of a plurality of separate particulate components, wherein at least one particulate component comprises a) from 5% to 60% by weight of the component of a surfactant system consisting essentially of (i) a primary anionic or nonionic surfactant selected from;

1) a $C_{14}$–$C_{20}$ alkyl sulfate salt;

2) an aliphatic $C_{12}$–$C_{20}$ alkane sulfonate salt;

3) a $C_{12}$–$C_{20}$ alkyl methyl ester sulfonate salt;

4) a polyhydroxy fatty acid amide having the formula

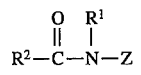

where $R^1$ is H, $C_1$–$C_4$ hydrocarbyl, 2 hydroxyethyl, 2-hydroxypropyl or a mixture thereof, $R^2$ is $C_{11}$–$C_{31}$ hydrocarbyl and Z is a poly hydroxyhydrocarbyl having a linear hydrocarbon chain with at least 3 hydroxy groups directly connected to said chain or an alkyoxylated derivative thereof;

and mixtures of any of the foregoing (ii) a water soluble $C_{11}$–$C_{18}$ alkyl ethoxysulfate salt containing an average of from 1 to 7 ethoxy groups per mole;

said primary anionic or nonionic surfactant or mixtures thereof and the water soluble $C_{11}$–$C_{18}$ alkyl ethoxysulfate salt being in intimate admixture and the weight ratio of the primary anionic or nonionic surfactant or mixtures thereof to the alkyl ethoxysulfate salt being from 2:1 to 19:1 provided that the level of the alkyl ethoxysulfate salt is from 0.25% to 10% by weight of the component;

b) from 15% to 95% by weight of the component of an organic and/or inorganic builder salt or a mixture of such salts;

wherein each surfactant-containing particulate component containing said surfactant system and the composition in total display improved dissolution characteristics, in particular an increased rate of dissolution.

Preferably, the particulate components containing said surfactant system are free of alkyl benzene sulfonate.

Each surfactant-containing particulate component may be either a spray-dried granule or a particulate agglomerate.

According to another aspect of the present invention there is provided a granular detergent composition having a density greater than 550 g/liter and formed of a plurality of separate particulate components, wherein at least one particulate component comprises (a) from 5% to 60% by weight of the component of a surfactant system consisting essentially of (i) a $C_{14}$–$C_{20}$ alkyl sulfate salt; and (ii) a water soluble $C_{11}$–$C_{18}$ alkyl ethoxysulfate salt containing an average of from 1 to 7 ethoxy groups per mole;

said alkyl sulfate salt and said water soluble $C_{11}$–$C_{18}$ alkyl ethoxysulfate salt preferably being in intimate admixture, and the weight ratio of the alkyl sulfate salt to the alkyl ethoxysulfate salt being from 2:1 to 19:1 provided that the level of the alkyl ethoxysulfate salt is from 0.25% to 10% by weight of the component; and (b) from 15% to 95% by weight of the component of an organic and/or inorganic builder salt or a mixture of such salts;

wherein the total level of anionic surfactant in said granular detergent composition is from 5% to 10% by weight of the composition, more preferably from 6% to 9% by weight of the composition and most preferably from 6.5% to 8% by weight of the composition. Said granular detergent composition provides good detergency performance even when used in wash solutions where cationic fabric softener components are present. Examples of cationic fabric softener components include the well known quaternary ammonium compounds. Cationic fabric softeners are disclosed for example in EP-A-0125,122, and copending European Application 91-202881.8 which discloses water-soluble quaternary ammonium compounds.

It is believed that the invention will be better understood by reference to the drawings labelled FIGS. 1–4. Each of FIGS. 1–4 is a graph of the percentage of a named surfactant in a particular granular component or product dissolved versus time. Full details of the method use to obtain the data represented graphically in these Figures is given later in the specification.

The concentrated granular compositions of the present invention have a bulk density of at least 550 g/liter, preferably at least 650 g/liter more usually about 700 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

Subject to the above bulk density limitations, the compositions of the invention can be made via a variety of methods including dry mixing, spray drying, agglomeration and granulation. A preferred method of making the compositions involves a combination of spray drying, agglomeration in a high speed mixer and dry mixing.

Compositions in accordance with the present invention comprise a plurality of separate particulate components. The particulates can have any suitable form such as granules, flakes, prills, marumes or noodles but are preferably granular. The granules themselves may be agglomerates formed by pan or drum agglomeration or by an in-line mixer and also may be spray dried particles produced by atomising an aqueous slurry of the ingredients in a hot air stream which removes most of the water. The spray dried granules are then subjected to densification steps, e.g. by high speed cutter mixers and/or compacting mills, to increase density before being reagglomerated.

Preferred compositions in accordance with the invention comprise at least one spray dried granular surfactant-containing component and at least one surfactant-containing particulate agglomerate component.

Where one or more surfactant-containing particulate components are spray dried granules these will preferably comprise in total at least 15%, more preferably from 25% to 45%, by weight of the composition. Where one or more surfactant-containing particulate components are particulate agglomerates these will preferably comprise in total from 1% to 50%, more preferably from 10% to 40% by weight of the composition.

Where the surfactant-containing particulates are the only multi ingredient components, the remainder of the ingredients can be added individually as dry solids, or can be sprayed on to either the particulate components or on to any or all of the solid ingredients.

Compositions according to one aspect of the present invention are formed with one or more surfactant-containing components that each comprise a particulate incorporating a) from 5% to 60% by weight of the component of a surfactant system consisting essentially of (i) a primary anionic or nonionic surfactant selected from;

1) a $C_{14}$–$C_{20}$ alkyl sulfate salt;

2) an aliphatic $C_{12}$–$C_{20}$ alkane sulfonate salt;

3) a $C_{12}$–$C_{20}$ alkyl methyl ester sulfonate salt;

4) a polyhydroxy fatty acid amide having the formula

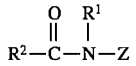

where $R^1$ is H, $C_1$–$C_4$ hydrocarbyl, 2 hydroxyethyl, 2-hydroxypropyl or a mixture thereof, $R^2$ is $C_{11}$–$C_{31}$ hydrocarbyl and Z is a poly hydroxyhydrocarbyl having a linear hydrocarbon chain with at least 3 hydroxy groups directly connected to said chain or an alkyoxylated derivative thereof;

and mixtures of any of the foregoing (ii) a water soluble $C_{11}$–$C_{18}$ alkyl ethoxysulfate salt containing an average of from 1 to 7 ethoxy groups per mole;

said primary anionic or nonionic surfactant or mixtures thereof and the water soluble $C_{11}$–$C_{18}$ alkyl ethoxysulfate salt being in intimate admixture and the weight ratio of the primary anionic or nonionic surfactant or mixtures thereof to the alkyl ethoxysulfate salt being from 2:1 to 19:1 provided that the level of the alkyl ethoxysulfate salt is from 0.25% to 10% by weight of the component;

b) from 15% to 95% by weight of the component of an organic and/or inorganic builder salt or a mixture of such salts;

The level of the surfactant system in the surfactant-containing particulate components is from 5% to 60% by weight. Where the particulate component is a spray dried granule the level of said surfactant system is preferably from 5% to 30%, and where the particulate component is a particulate agglomerate the level is preferably from 15% to 60%.

The $C_{14}$–$C_{20}$ alkyl sulfate salts may be derived from natural or synthetic hydrocarbon sources. Preferred examples of such salts include the substantially branched $C_{14}$–$C_{15}$ alkyl sulfate salts, that is where the degree of branching of the $C_{14}$–$C_{15}$ alkyl chain is greater than about 20%. Such substantially branched $C_{14}$–$C_{15}$ alkyl sulfate salts are usually derived from synthetic sources. Also preferred are $C_{16}$–$C_{20}$ alkyl sulfate salts which are usually derived from natural sources such as tallow fat and marine oils.

Use of alkane sulfonate salts as anionic surfactants is well known in the art, being disclosed for example in U.S. Pat. No. 3,929,678. Aliphatic alkane sulfonate salts may be obtained from the reaction of an aliphatic hydrocarbon, which may include the iso-, neo-, meso- and n-paraffins, having 12 to 24 carbon atoms and a sulfonating agent which may for example be $SO_3$, $H_2SO_4$ or oleum the reaction being carried out according to known sulfonation methods, including bleaching and hydrolysis. In accord with the present invention the aliphatic $C_{12}$–$C_{20}$ alkane sulfonate salts are preferred with the aliphatic $C_{14}$–$C_{20}$ alkane sulfonate salts being most preferred. Preferred as cations are the alkali metal and ammonium cations.

Alkyl ester sulfonate surfactants hereof include linear esters of $C_{12}$–$C_{20}$ carboxylic acids (ie. fatty acids) which are sulfonated with gaseous $SO_3$ according to "The Journal of the American Oil Chemists Society," 52 (1975), pp. 323–329. Suitable starting materials include natural fatty substances as derived from tallow, palm oil, etc.

The preferred alkyl ester sulfonate surfactants in accord with the invention comprise methyl ester sulfonate surfactants of the structural formula:

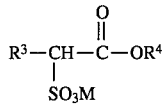

wherein $R^3$ is a $C_{12}$–$C_{20}$ alkyl, $R^4$ is methyl and M is a cation which forms a salt with the methyl ester sulfonate. Suitable salt-forming cations include metals such as sodium, potassium, and lithium, and substituted or unsubstituted ammonium cations, such as monoethanolamine, diethanolamine, and triethanolamine. Most preferably, $R^3$ is $C_{14}$–$C_{20}$ alkyl.

The polyhydroxy fatty acid amide surfactants in accord with the present invention comprise compounds of the structural formula:

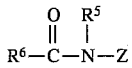

wherein: $R^5$ is H, $C_1$–$C_4$ hydrocarbyl, 2-hydroxy ethyl, 2-hydroxypropyl, or a mixture thereof, preferably $C_1$ or $C_2$ alkyl, most preferably $C_1$ alkyl (ie. methyl); and $R^6$ is a $C_{11}$–$C_{31}$ hydrocarbyl, preferably straight chain $C_{11}$–$C_{19}$ alkyl, or alkanyl most preferably straight chain $C_{16}$–$C_{18}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose.

As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, i$—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

$R^5$ can be, for example, N-methyl, N-ethyl, N-propyl, N-isopropyl, N-butyl, N-2-hydroxy ethyl, or N-2-hydroxypropyl.

$R^6—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula

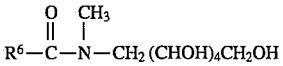

wherein $R^6$ is a $C_{11}$–$C_{19}$ straight-chain alkyl or alkenyl group.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhdroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in GB Patent Specification 809 060, published Feb. 18, 1959, by Thomas Hedley & Co Ltd, U.S. Pat. No. 2,965,576, issued Dec. 20, 1960 to E R Wilson, and U.S. Pat. No. 1,985,424, issued Dec. 25, 1934 to Piggott, each of which is incorporated herein by reference.

The $C_{11}$–$C_{18}$ alkyl ethoxysulfate salt comprises a primary alkyl ethoxysulfate which is derived from the condensation product of a $C_{11}$–$C_{18}$ alcohol condensed with an average of from one to seven ethylene oxide groups, per mole. Preferred are the $C_{12}$–$C_{15}$ alkyl ethoxysulfate salts with an average of from one to five ethoxy groups per mole, and most preferably with an average of from one to three ethoxy groups per mole.

The $C_{11}$–$C_{18}$ alcohol itself can be obtained from natural or synthetic sources. Thus, $C_{11}$–$C_{18}$ alcohols, derived from natural fats, or Ziegler olefin build-up, or OXO synthesis can form suitable sources for the alkyl group. Examples of synthetically derived materials include Dobanol 25 (RTM) sold by Shell Chemicals (UK) Ltd which is a blend of $C_{12}$–$C_{15}$ alcohols, Ethyl 24 sold by the Ethyl Corporation, a blend of $C_{13}$–$C_{15}$ alcohols in the ratio 67% $C_{13}$, 33% $C_{15}$ sold under the trade name Lutensol by BASF GmbH and Synperonic (RTM) by ICI Ltd., and Lial 125 sold by Liquichimica Italiana. Examples of naturally occurring materials from which the alcohols can be derived are coconut oil and palm kernel oil and the corresponding fatty acids.

The weight ratio of the primary anionic or nonionic surfactant or mixtures thereof to the $C_{11}$–$C_{18}$ alkyl ethoxysulfate in a particulate component is from 2:1 to 19:1 more preferably from 3:1 to 12:1 and most preferably from 3.5:1 to 10:1. The level of $C_{11}$–$C_{18}$ alkyl ethoxysulfate in a particulate component is from 0.25% to 10% more preferably from 0.5% to 5% and most preferably from 1% to 3% by weight of the component.

For the purposes of the present invention it is important that the primary anionic or nonionic surfactants or mixtures thereof and the $C_{11}$–$C_{18}$ alkyl ethoxysulfates are in intimate admixture, that is they should be mixed prior to the formation of the particulate. In the case of a spray dried granule, this mixing can take place in the slurried mixture fed to the spray drying equipment. Where another type of granule is formed an intimate mixture of the surfactants should be made before agglomeration, milling, flaking, prilling or any other particulate forming process takes place.

Another major ingredient of the surfactant-containing particulate components is one or more non-phosphate inorganic or organic builder salts that provide the crystalline structure for the granules. The inorganic and/or organic builder salts may be water-soluble or water-insoluble and can include, but are not restricted to alkali metal carbonates, bicarbonates, silicates, aluminosilicates, monomeric polycarboxylates, homo or copolymeric polycarboxylic acids or their salts in which the polycarboxylic acid comprises at least two carboxylic radicals separated from each other by not more than two carbon atoms, organic phosphonates and aminoalkylene poly (alkylene phosphonates) and mixtures of any of the foregoing.

The builder salt is present in the particulate components in an amount from 15% to 95% by weight.

If the particulate component is a spray dried granule the builder salt component is present more preferably in an amount from 25% to 85% by weight of the particulate and if the particulate component is a particulate agglomerate more preferably in an amount from 20% to 85% by weight of the particulate.

Preferred builder systems are free of boron compounds and any polymeric organic materials are preferably biodegradable.

Suitable silicates are those having an $SiO_2$:$Na_2O$ ratio in the range from 1.6 to 3.4, the so-called amorphous silicates of $SiO_2$:$Na_2O$ ratios from 2.0 to 2.8 being employed where addition to the mixture of ingredients that are spray dried is required. Where aluminosilicates constitute an ingredient of the mixture to be spray dried, silicates should not be present in the mixture but can be incorporated in the form of an aqueous solution serving as an agglomerating agent for other solid components, or, where the silicates are themselves in particulate form, as solids to the other particulate components of the composition. However, for compositions in which the percentage of spray dried components is low i.e. 30%, it is preferred to include the amorphous silicate in the spray-dried components.

Whilst a range of aluminosilicate ion exchange materials can be used, preferred sodium aluminosilicate zeolites have the unit cell formula $$Na_z[(AlO_2)_z(SiO_2)_y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [6 grains/gallon/minute/(gram/gallon)], based on calcium ion hardness. Optimum aluminosilicates for builder purposes exhibit a calcium ion exchange rate of at least 260 mg equivalent of $CaCO_3$/liter/minute/(gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite X, Zeolite HS and mixtures thereof. In an especially preferred embodiment, the crystalline aluminosilicate ion exchange material is Zeolite A and has the formula $$Na_{12}[(AlO_2)_{12}(SiO_2)_{12}].xH_2O$$

wherein x is from 20 to 30, especially 27. Zeolite X of formula $Na_{86}$ $[(AlO_2)_{86}(SiO_2)_{106}]$. 276 $H_2O$ is also suitable, as well as Zeolite HS of formula $Na_6$ $[(AlO_2)_6(SiO_2)_6]7.5$ $H_2O$).

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The logarithmic acidity constant is defined by reference to the equilibrium $$H^+ + A^- \leftrightarrows HA$$

where $A^-$ is the fully ionized carboxylate anion of the builder salt.

The equilibrium constant is therefore $$K_1 = \frac{(HA)}{(H^+)\,(A^-)}$$

and $pK_1 = \log_{10}K$.

For the purposes of this specification, acidity constants are defined at 25° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

Preferred carboxylates can also be defined in terms of their calcium ion stability constant ($pK_{Ca}{++}$) defined, analogously to $pK_1$, by the equations $$pK_{Ca}{++} = \log_{10}K_{Ca}{++}$$

where $$K_{Ca}{++} = \frac{(Ca^{++}\,A)}{(Ca^{++})\,(A)}\,.$$

Preferably, the polycarboxylate has a $pK_{Ca++}$ in the range from about 2 to about 7 especially from about 3 to about 6. Once again literature values of stability constant are taken where possible. The stability constant is defined at 25° C. and at zero ionic strength using a glass electrode method of measurement as described in Complexation in Analytical Chemistry by Anders Ringbom (1963).

The carboxylate or polycarboxylate builder can be momomeric or oligomeric in type although monomeric polycarboxylates are generally preferred for reasons of cost and performance.

Monomeric and oligomeric builders can be selected from acyclic, alicyclic, heterocyclic and aromatic carboxylates having the general formulae (a)

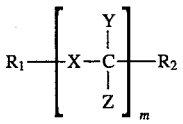

-continued (b)

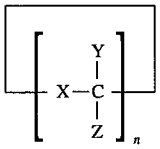

or (c)

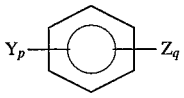

wherein $R_1$ represents $H,C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents $H,C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy;hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6; and wherein, X, Y, and Z each have the same or different representations when repeated in a given molecular formula, and wherein at least one Y or Z in a molecule contain a carboxyl group.

Suitable carboxylates containing one carboxy group include lactic acid, glycolic acid and ether derivatives thereof as disclosed in Belgian Patent Nos. 831 368, 821 369 and 821 370.

Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2 446 686, and 2 446 687 and U.S. Pat. No. 3,935,257 and the sulfinyl carboxylates described in Belgian Patent No. 840 623. Polycarboxylates containing three carboxy groups include, in particular, water-soluble citrates, aconitrates and citraconates as well as succinate derivatives such as the carboxymethyloxysuccinates described in British Patent No. 1 379 241, lactoxysuccinates described in British Patent No. 1 389 732, and aminosuccinates described in Netherlands Application 7 205 873, and the oxypolycarboxylate materials such as 2-oxa-1,1,3-propane tricarboxylates described in British Patent No. 1 387 447.

Polycarboxylates containing four carboxy groups include oxydisuccinates disclosed in British Patent No. 1 261 829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1 398 421 and 1 398 422 and in U.S. Pat. No. 3,936,448, and the sulfonated pyrolysed citrates described in British Patent No. 1 439 000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1 425 343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or copolymeric polycarboxylic acids or their salts in which the polycarboxylic acid comprises at least two carboxyl radicals separated from each other by not more than two carbon atoms. Polymers of the latter type are disclosed in GB-A-1 596 756. Examples of such salts are polyacrylates of MWt 2000–5000 and their copolymers with maleic anhydride, such copolymers having a molecular weight of from 20 000 to 100 000, especially from 70 000 to 90 000. These materials are normally used at levels of from 0.5% to 10% by weight more preferably from 0.75% to 8%, most preferably from 1% to 6% by weight of the composition.

Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired.

These phosphonate materials are normally present at levels less than 5% by weight, more preferably less than 3% by weight and most preferably less than 1% by weight of the compositions.

In the concentrated detergent compositions of the present invention it is preferred that water-soluble sulfate, particularly sodium sulfate, should be present at a level of not more than 5% and preferably at a level of not more than 2.5% by weight of the composition. Preferably no sodium sulfate is added as a separate ingredient and its incorporation as a by-product e.g. with the sulfated surfactants, should be minimised.

The particulate components can also include miscellaneous ingredients preferably in a total amount of from 0% to 45% by weight, examples of such ingredients being optical brighteners, antiredeposition agents, photoactivated bleaches (such as tetrasulfonated zinc phthalocyanine) and heavy metal sequestering agents. Where one or more of the particulate components is a spray dried powder it will normally be dried to a moisture content of from 7% to 11% by weight, more preferably from 8% to 10% by weight of the spray dried powder. Moisture contents of powders produced by other processes such as agglomeration may be lower and can be in the range 1–10% by weight.

The particle size of the particulate components is conventional and preferably not more than 5% by weight should be above 1.4 mm, while not more than 10% by weight should be less than 0.15 mm in maximum dimension. Preferably at least 60%, and most preferably at least 80%, by weight of the powder lies between 0.7 mm and 0.25 mm in size. Preferred detergent compositions in accordance with the invention comprise at least one spray dried granular surfactant-containing particulate component and at least one surfactant-containing particulate agglomerate component.

For spray dried powders, the bulk density of the particles from the spray drying tower is conventionally in the range from 400 to 450 g/liter and this is then enhanced by further processing steps such as size reduction in a high speed cutter/mixer followed by compaction preferably to achieve a final density of greater than 550 g/liter. Alternatively, processes other than spray drying may be used to form a high density particulate directly.

Where the particulate components are particulate agglomerates the bulk density of these components will be a function of their mode of preparation. However, the preferred form of such components is a mechanically mixed agglomerate which may be made by adding the ingredients dry or with an agglomerating agent to a pan agglomerator, Z blade mixer or more preferably an in-line mixer such as those manufactured by Schugi (Holland) BV, 29 Chroomstraat 8211 AS, Lelystad, Netherlands and Gebruder Lodige MaschinenbanGmbH, D-4790 Paderborn 1, Elsenerstrasse 7-9, Postfach 2050 F.R.G. By this means the second component can be given a bulk density in the range from 650 g/liter to 1190 g/liter more preferably from 700 g/liter to 850 g/liter.

Preferably any particulate agglomerate components include sodium carbonate at a level of from 20% to 40% by weight of the component. Preferably, the composition includes from 3% to 18% sodium carbonate by weight of the composition, more preferably from 5% to 15% by weight.

A highly preferred ingredient of any particulate agglomerate components is also a hydrated water insoluble aluminosilicate ion exchange material of the synthetic zeolite type, described hereinbefore, present at from 10% to 55% by weight of the second component. The amount of water insoluble aluminosilicate material incorporated in this way is from 1% to 15% by weight of the composition, more preferably from 2% to 10% by weight.

In one process for preparing the particulate agglomerate component, the surfactant salt is formed in situ in an inline mixer. The liquid acid form of the surfactant is added to a mixture of particulate anhydrous sodium carbonate and hydrated sodium aluminosilicate in a continuous high speed blender, such as a Lodige KM mixer, and neutralised to form the surfactant salt whilst maintaining the particulate nature of the mixture. The resultant agglomerated mixture forms the second component which is then added to other components of the product. In a variant of this process, the surfactant salt is preneutralised and added as a viscous paste to the mixture of the other ingredients. In the variant, the mixer serves merely to agglomerate the ingredients to form the second component.

Preferred compositions in accordance with the invention comprise one or more multi-ingredient particulate components which may also contain one or more additional surfactants which may be water-soluble. These surfactants may be anionic, nonionic, cationic or semipolar in type or a mixture of any of these and should comprise no more than 10% by weight of the composition.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981.

Preferably the granular detergent compositions in accordance with the invention will comprise from 2% to 9% additional nonionic surfactant by weight of the total detergent composition. Additional nonionic surfactant is an especially preferred component of the detergent compositions in accord with the invention when the total level of anionic surfactant is from 5% to 10% by weight of the composition.

One class of nonionic surfactants useful in the present invention comprises condensates of ethylene oxide with a hydrophobic moiety, providing surfactants having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred additional nonionic surfactants of this type are the $C_{12}$–$C_{20}$ primary alcohol ethoxylates containing an average of from 3–11 moles of ethylene oxide per mole of alcohol, particularly the $C_{12}$–$C_{15}$ primary alcohol ethoxylates containing an average of from 3–7 moles of ethylene oxide per mole of alcohol and most preferably the $C_{12}$–$C_{15}$ primary alcohol ethoxylates containing an average of 3 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent compositions are disclosed in EP-B 0 070 074, 0 070 077, 0 075 996 and 0 094 118.

A further class of surfactants are the semi-polar surfactants such as amine oxides. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

The particulate components may have any suitable physical form, i.e. it may take the form of flakes, prills, marumes, noodles, ribbons, or granules which may be spray-dried or non spray-dried agglomerates.

Although any further component could in theory comprise a water-soluble surfactant on its own, in practice at least one organic or inorganic salt is included to facilitate processing. This provides a degree of crystallinity, and hence acceptable flow characteristics, to the particulate and may be any one or more of the organic or inorganic salts present in the first component.

Where there is only one surfactant-containing component in the composition one or more other ingredients will be added as particulate components and will preferably also be present where more than one surfactant-containing particulate components forms part of the composition. Thus one or more of oxygen bleaches, photoactivated bleaches, bleach activators, builder salts, detergent enzymes, suds suppressors, fabric softening agents, soil suspension and antiredeposition agents, soil release polymers, and optical brighteners can be added as solids to the one or more surfactant-containing particulate components.

Suitable oxygen bleaches include the inorganic perhydrates such as sodium perborate monohydrate and tetrahydrate, sodium percarbonate, sodium perphosphate and sodium persilicate. Sodium percarbonate and the sodium perborate salts are most preferred. These materials are normally added as crystalline solids and, in the case of sodium percarbonate, may be coated with e.g. silicate in order to aid stability. Usage levels range from 3% to 22% by weight, more preferably from 8% to 18% by weight.

Photoactivated bleaches include the zinc and aluminium salts of tri and tetra sulfonated phthalocyanine which are normally added as dispersions in other materials because of their low levels of usage, typically from 0.0005 to 0.01% by weight of the composition.

Bleach activators or peroxy acid bleach precursors can be selected from a wide range of classes and are preferably those containing one or more N- or O-acyl groups.

Suitable classes include anhydrides, esters, imides and acylated derivatives of imidazoles and oximes, and examples of useful materials within these classes are disclosed in GB-A-1586789. The most preferred classes are esters such as are disclosed in GB-A-836 988, 864 798, 1 147 871 and 2 143 231 and imides such as are disclosed in GB-A-855 735 & 1 246 338. Levels of incorporation range from 1% to 10% more generally from 2% to 6% by weight of the composition.

Particularly preferred precursor compounds are the N-,N,$N^1N^1$ tetra acetylated compounds of formula

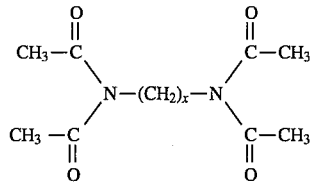

wherein x can be O or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907 356. The most preferred peroxyacid bleach precursor is TAED.

Solid peroxyacid bleach precursors useful in compositions of the present invention have a Mpt>30° C. and preferably >40° C. Such precursors will normally be in fine powder or crystalline form in which at least 90% by weight of the powder has a particle size >150 micrometers.

This powder is usually agglomerated to form particulate material, at least 85% of which has a particle size between 400 and 1700 micrometers. Suitable agglomerating agents include aliphatic mono and polycarboxylic acids, $C_{12}$–$C_{18}$ aliphatic alcohols condensed with from 10 to 80 moles of ethylene oxide per mole of alcohol, cellulose derivatives such as methyl, carboxymethyl and hydroxyethyl cellulose, polyethylene glycols of MWt 4,000–10,000 and polymeric materials such as polyvinyl pyrrolidone.

The precursors are preferably coated with an organic acid compound such as citric or glycolic acid, as disclosed in the commonly assigned copending British Patent Application No. 9102507.2 filed Feb. 6, 1991.

Builder salts that can advantageously be added as solid particulates include silicates and certain polycarboxylate builders such as citrates.

Dry mix addition of amorphous sodium silicates, particularly those of $SiO_2$:$Na_2O$ ratio of from 2.0:1 to 3.2:1 is employed where aluminosilicates form part of a spray dried component, in order to avoid the formation of insoluble reaction products. Furthermore the incorporation of crystalline, so called 'layered' silicates into detergent compositions necessitates their addition as solids.

These crystalline layered sodium silicates have the general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0 164 514 and methods for their preparation are disclosed in DE-A-3 417 649 and DE-A-3 742 043. For the purposes of the present invention, x in the general formula above has a value of 2, 3 or 4 and is preferably 2. More preferably M is sodium and y is 0 and preferred examples of this formula comprise the $\gamma$ and $\delta$ forms of $Na_2Si_2O_5$. These materials are available from Hoechst AG FRG as respectively NaSKS-11 and NaSKS-6. The most preferred material is $\delta$-$Na_2Si_2O_5$, (NaSKS-6). Crystalline layered silicates are incorporated either as dry mixed solids, or as solid components of agglomerates with other components.

Anti-redeposition and soil-suspension agents suitable herein include cellulose derivatives such as methylcellulose, carboxymethylcellulose and hydroxyethycellulose, and homo-or co-polymeric polycarboxylic acids or their salts. Polymers of this type include copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Preferred optical brighteners are anionic in character, examples of which are disodium 4,4$^1$-bis-(2-diethanolamino-4-anilino-s-triazin-6-ylamino)stilbene-2:2$^1$ disulphonate, disodium 4,4$^1$-bis-(2-morpholino-4-anilino-2-triazin-6-ylaminostilbene-2:2$^1$-disulphonate,disodium 4,4$^1$-bis-(2,4-dianilino-s-triazin-6-ylamino)stilbene-2:2$^1$-disulphonate, monosodium 4$^1$,4$^{11}$-bis-(2,4-dianilino-s-triazin-6 ylamino)stilbene-2-sulphonate, disodium 4,4$^1$-bis-(2-anilino-4-(N-methyl-N-2-hydroxyethylamino)-2-triazin-6-ylamino)stilbene-2,2$^1$-disulphonate, disodium 4,4$^1$-bis-(4-phenyl-2,1,3-triazol-2-yl)stilbene-2,2$^1$ disulphonate, disodium 4,4$^1$bis(2-anilino-4-(1-methyl-2-hydroxyethylamino)-s-triazin-6-ylamino)stilbene-2,2$^1$disulphonate and sodium 2(stilbyl-4$^{11}$-(naphtho-1$^1$,2$^1$:4,5)-1,2,3-triazole-2$^{11}$-sulphonate.

Soil-release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4,116,885 and 4,711,730 and European Published Patent Application No. 0 272 033. A particular preferred polymer in accordance with EP-A-0 272 033 has the formula $$(CH_3(PEG)_{43})_{0.75}(POH)_{0.25}[T\text{-}PO)_{2.8}(T\text{-}PEG)_{0.4}]T(POH)_{0.25}((PEG)_{43}CH_3)_{0.75}$$

where PEG is —$(OC_2H_4)O$—,PO is $(OC_3H_6O)$ and T is $(pCOC_6H_4CO)$.

Certain polymeric materials such as polyvinyl pyrrolidones typically of MWt 5000–20000, preferably 10000–15000, also form useful agents in preventing the transfer of labile dyestuffs between fabrics during the washing process.

Another optional detergent composition ingredient is a suds suppressor, exemplified by silicones, and silica-silicone mixtures. Silicones can be generally represented by alkylated polysiloxane materials while silica is normally used in finely divided forms, typified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

Suitable silicone suds controlling agents are disclosed in U.S. Pat. No. 3,933,672 and DTOS 2 646 126, an example of the latter being DC0544, a self emulsifying siloxane/glycol copolymer commercially available from Dow Corning. A particularly preferred suds suppressor system based on a silica silicone mixture comprises 78% starch, 12% stearyl alcohol binder and 10% of a silica/silicone blend available from Dow Corning under the reference X2/3419. This system is the subject of European Patent No. 0 218 721.

The preferred methods of incorporation comprise either application of the suds suppressors in liquid form by spray-on to one or more of the major components of the composition or alternatively the formation of the suds suppressors into separate particulates that can then be mixed with the other solid components of the composition. A preferred example of such a particulate is a crystalline or amorphous aluminosilicate zeolite on to which the suds suppressor is absorbed. Suds suppressor particulates of this type are the subject of the commonly assigned copending European Application No. 91201343.0. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned U.S. Pat. No. 3,933,672.

The suds suppressors described above are normally employed at levels of from 0.01% to 5.0% by weight of the composition, preferably from 0.01% to 1.5% by weight, and most preferably from 0.1% to 1.2% by weight.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Fabric softening agents can also be incorporated into detergent compositions in accordance with the present invention. These agents may be inorganic or organic in type. Inorganic softening agents are exemplified by the smectite clays disclosed in GB-A-1 400 898. Organic fabric softening agents include the water insoluble tertiary amines as disclosed in GB-A-1 514 276 and EP-B-0 011 340.

Their combination with mono $C_{12}$–$C_{14}$ quaternary ammonium salts is disclosed in EP-B-0 026 527 & 0 026 528. Other useful organic fabric softening agents are the dilong chain amides as disclosed in EP-B-0 242 919. Additional organic ingredients of fabric softening systems include high molecular weight polyethylene oxide materials as disclosed in EP-A-0 299 575 and 0 313 146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

In a particularly preferred process for making detergent compositions in accordance with the invention, part of the spray dried product comprising one of the granular components is diverted and subjected to a low level of nonionic surfactant spray on before being reblended with the remainder. A second granular component is made using the preferred process described above. The first and second components together with perhydrate bleach, bleach precursor particulate, other dry mix ingredients such as any carboxylate chelating agent, soil-release polymer, silicate of conventional or crystalline layered type, and enzyme are then fed to a conveyor belt, from which they are transferred to a horizontally rotating drum in which perfume and silicone suds suppressor are sprayed on to the product. In highly preferred compositions, a further drum mixing step is employed in which a low (approx. 2% by weight) level of finely divided crystalline material is introduced to increase density and improve granular flow characteristics.

In preferred concentrated detergent products incorporating an alkali metal percarbonate as the perhydrate salt it has been found necessary to control several aspects of the product such as its heavy metal ion content and its equilibrium relative humidity. Sodium percarbonate-containing compositions of this type having enhanced stability are disclosed in the commonly assigned British Application No. 9021761.3 filed Oct. 6 1990 Attorney's Docket No. CM343.

Dissolution Characteristics

The detergent compositions of the invention are intended to be used with delivery systems that provide transient localised high concentrations of product in the drum of an automatic washing machine at the start of the wash cycle. These delivery systems avoid problems associated with loss of product in the pipework or sump of the machine and the high transient concentrations provide fabric cleaning benefits.

High transient concentrations require rapid dissolution/dispersion of the composition but this is difficult with surfactant containing particulate components in which the one or more primary anionic or nonionic surfactants are relatively insoluble and hence make the component hydrophobic in nature. The incorporation of a low level of a water soluble $C_{11}$–$C_{18}$ alkyl ethoxysulfate material into the primary anionic or nonionic surfactant-containing particulate has however been found to enable acceptable rate of dissolution characteristics to be achieved whilst retaining the detergency provided by the primary anionic or nonionic surfactants.

It has been found that dissolution/dispersion of a detergent product can be correlated with the rate of increase of the conductivity of an aqueous mixture of the product under standardised conditions. Thus a conductivity test method may be used to evaluate the dissolution characteristics of a detergent composition or any individual particulate components of such a composition.

The conductivity test method is carried out as follows: A 1 liter glass beaker is filled with 1000 ml distilled water at 20° C. and the contents agitated using a magnetic stirrer set at approximately 200 rpm. A conductivity probe is inserted into the beaker, 10 g of detergent product of particle size p where 1.4 mm>p>250 m is added and a profile of conductivity vs time is then measured. The conductivity value measured at the 10 minute point is taken to represent 100% solubility and the time in seconds to reach 95% of this value is determined and recorded as the $T_{95}$ value.

The T95 values for spray dried blown powder products having compositions which contain low levels of alkyl ethoxysulfate salt in the surfactant system, and for comparison those which do not contain alkyl ethoxysulfate, have been obtained. These spray dried products were obtained from a pilot plant scale process.

The physical characteristics, including the particulate size and bulk density, of pilot plant products may differ from those provided on a full plant scale. Correspondingly, the dissolution characteristics of such pilot plant products may also not be in exact accord with those of full plant products which possess the same composition but differing physical characteristics. However, any benefits associated with the introduction into the composition of a compound which aids the rate of dissolution are likely to be demonstrated by both pilot plant and full scale plant products containing this compound.

Accordingly, the T95 results presented here which demonstrate that the presence of a low level of alkyl ethoxysulfate in the pilot plant spray dried products provide improved rate of dissolution characteristics may be used to indicate that such a benefit would also be expected for such product obtained from a full scale plant process.

Spray dried products were prepared on a pilot plant scale having the following compositions

| | A | B | C |
|---|---|---|---|
| LAS | 10.3 | — | — |
| TAS | 7.0 | 8.0 | 8.1 |
| 25AE3S | — | 1.8 | — |
| Zeolite A | 44.5 | 46.8 | 47.7 |
| MA/AA | 12.3 | 15.5 | 15.8 |

-continued

| | A | B | C |
|---|---|---|---|
| DETPMP | 1.2 | 1.4 | 1.5 |
| Optical Brightener | 0.7 | 0.9 | 0.9 |
| CMC | 1.4 | 1.8 | 1.8 |
| $MgSO_4$ | 1.2 | 1.5 | 1.5 |
| Moisture & Misc. | | to 100 | |

All three pilot plant compositions were made by a spray drying technique and had a product bulk density in each instance of about 400 g/liter.

$T_{95}$ measurements according to the conductivity test method described hereinbefore on the three spray dried products gave the following values

| | |
|---|---|
| Composition A | 62 secs |
| Composition B | 60 secs |
| Composition C | 83 secs |

It can be seen that Composition B, in accordance with the invention, has a similar rate of dissolution, to the prior art composition A, and is superior to Composition C, from which the water soluble alkyl ethoxysulfate had been omitted.

Products D & E having the same composition as Product B of Example 1 except that the 25AE3S levels were 3.6% and 0.9% by weight respectively, were made using the method of preparation employed for Product B. $T_{95}$ measurements according to the conductivity test method described hereinbefore on the two products gave the following values

| | |
|---|---|
| Composition D | 50 secs. |
| Composition E | 69 secs |

Accordingly the dissolution characteristics of the granular detergent compositions according to the present invention or the particulate components containing the surfactant system of the invention, are such that the time ($T_{95}$) for a 10 g sample, dispersed in 1000 g distilled water at 20° C., to achieve a conductivity value that is 95% of its conductivity value at 10 minutes, is preferably not more than 70 seconds. More preferably the $T_{95}$ value is not more than 65 seconds and most preferably is 60 seconds or less.

A further method to evaluate the dispersion/dissolution characteristics of a granular detergent composition or any surfactant-containing particulate components of such a composition involves measurement at suitable time intervals of the percentage of primary surfactant dissolved when a known amount of said particulate components or said composition are dissolved in a known amount of water under standardised conditions.

This surfactant release test method is carried out as follows: A glass beaker is filled with one liter of de-ionised water and placed in a fixed temperature bath set at 20° C. The liquid is stirred using a magnetic stirrer set at approximately 200 rpm and the apparatus is left for a period of at least 20 minutes until the contents of the beaker have reached the bath temperature. 10 g of granular product of known composition and of particle size p where 1.4 mm>p>250 m is then added to the contents of the beaker and simultaneously a stop-watch is started. Using a syringe 5 ml samples are removed at set time intervals. These samples are quickly filtered through a filter of pore size 0.45 m to remove particulate material and the amount of surfactant in the filtrate is then determined using an appropriate physical or chemical method.

The present invention is particularly concerned with improved rate of dissolution characteristics in the early stages of a wash process. This consideration dictates the time intervals at which the 5 ml samples in the above test method are taken. At least two samples are hence taken in the first five minutes.

The maximum amount of surfactant which could dissolve under the given conditions is obtained by reference to the known composition of the granular product. Hence the percentage of surfactant dissolved in the 5 ml sample taken at each time interval is obtained as a percentage of this maximum possible amount.

The full test procedure is repeated at least twice or until reproducible results are obtained. The physical method used to determine the amount of surfactant in the filtered samples will depend on the nature of the surfactant. Suitable methods may include chemical methods, including titrations, or physical methods including HPLC and spectroscopic methods.

Once reproducible results have been obtained a graph may then be plotted of the percentage of surfactant in the composition dissolved versus time. A quantitative measurement of the rate of dissolution characteristics of each sample may be obtained from the area under the curve of such a graph measured between set time limits. The area under the curve may be obtained using an approximate numerical integration method, a preferred example of which is the trapezium rule as described on page 127 of Mathematics for Chemists by G J Kyrich, published by Butterworths Scientific Publications, 1955. The ratios of the area under the curves obtained for different samples allow relative rates of dissolution, and hence rate of dissolution benefits, to be quantified.

An 'initial rate of dissolution benefit' is now defined as ratio of the areas under the curves for graphs of percentage of surfactant dissolved versus time from the start of the experiment evaluated between zero minutes and five minutes, for samples dissolved according to the surfactant release method as hereinbefore described.

The dissolution characteristics in accord with the present invention are such that when a 10 g sample of either a) any surfactant-containing particulate component containing the surfactant system of the present invention or b) a granular detergent composition according to the present invention is dissolved in one liter of de-ionised water at 20° C., this being agitated by a magnetic stirrer set at 200 rpm, the rate of dissolution of the primary anionic or nonionic surfactants in the first five minutes is greater than for similar surfactant-containing particulate components or compositions in total, differing from (a) and (b) in that they do not contain alkyl ethoxysulfate in intimate admixture with the primary anionic or nonionic surfactants, are dissolved under the same conditions, such that the 'initial rate of dissolution benefit' is greater than 1.15, preferably greater than 1.2, more preferably greater than 1.25 and most preferably greater than 1.3.

Delivery Systems

Delivery systems for introducing the compositions of the invention into an automatic washing machine can take a number of forms. Thus a composition can be incorporated in a bag or container from which it is rapidly releasable at the start of the wash cycle in response to agitation, a rise in temperature or immersion in the wash water in the drum. Alternatively the washing machine itself may be adapted to permit direct addition of the composition to the drum e.g. by a dispensing arrangement in the access door.

Products comprising a detergent composition enclosed in a bag or container are usually designed in such a way that container integrity is maintained in the dry state to prevent egress of the contents when dry, but are adapted for release of the container contents on exposure to a washing environment, normally on immersion in an aqueous solution.

Usually the container will be flexible, such as a bag or pouch. The bag may be of fibrous construction coated with a water impermeable protective material so as to retain the contents, such as is disclosed in European published Patent Application No. 0 018 678. Alternatively it may be formed of a water-insoluble synthetic polymeric material provided with an edge seal or closure designed to rupture in aqueous media as disclosed in European published Patent Application Nos. 0 011 500, 0 011 501, 0 011 502, and 0 011 968. A convenient form of water frangible closure comprises a water soluble adhesive disposed along and sealing one edge of a pouch formed of a water impermeable polymeric film such as polyethylene or polypropylene. In a variant of the bag or container form, laminated sheet products can be employed in which a central flexible layer is impregnated and/or coated with a composition and then one or more outer layers are applied to produce a fabric-like aesthetic effect. The layers may be sealed together so as to remain attached during use or may separate on contact with water to facilitate the release of the coated or impregnated material.

An alternative laminate form comprises one layer embossed or deformed to provide a series of pouch-like containers into each of which the detergent components are deposited in measured amounts, with a second layer overlying the first layer and sealed thereto in those areas between the pouch-like containers where the two layers are in contact. The components may be deposited in particulate, paste or molten form and the laminate layers should prevent egress of the contents of the pouch-like containers prior to their addition to water. The layers may separate or may remain attached together on contact with water, the only requirement being that the structure should permit rapid release of the contents of the pouch-like containers into solution. The number of pouch-like containers per unit area of substrate is a matter of choice but will normally vary between 500 and 25,000 per square meter.

Suitable materials which can be used for the flexible laminate layers in this aspect of the invention include, among others, sponges, paper and woven and non-woven fabrics.

However the preferred means of carrying out the process of the invention is to introduce the composition into the liquid surrounding the fabrics that are in the drum via a reusable dispensing device having walls that are permeable to liquid but impermeable to the solid composition.

Devices of this kind are disclosed in European Patent Application Publication Nos. 0 343 069 & 0 343 070. The latter Application discloses a device comprising a flexible sheath in the form of a bag extending from a support ring defining an orifice, the orifice being adapted to admit to the bag sufficient product for one washing cycle of an automatic process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

Preferred dispensing devices are reusable and are designed in such a way that container integrity is maintained in both the dry state and during the wash cycle. Especially preferred dispensing devices for use in accord with the invention have been described in the following patents; GB-B-2,157, 717, GB-B-2, 157, 718, EP-A-0201376, EP-A-0288345 and EP-A-0288346. An article by J. Bland published in Manufacturing Chemist, November 1989, pages 41–46 also describes especially preferred dispensing devices for use with granular laundry produts which are of a type commonly known as the "granulette".

The invention is illustrated in the following non limiting Examples, in which all percentages are on a weight basis unless otherwise stated.

In the detergent compositions, the abbreviated component identifications have the following meanings:

LAS: Sodium linear $C_{12}$ alkyl benzene sulphonate

TAS: Sodium tallow alcohol sulfate

45AS: Sodium $C_{14}$–$C_{15}$ alkyl sulfate

25AE3S: $C_{12}$–$C_{15}$ alkyl ethoxysulfate containing an average of three ethoxy groups per mole $TAE_n$: Tallow alcohol ethoxylated with n moles of ethylene oxide per mole of alcohol 25E3: A $C_{12-15}$ primary alcohol condensed with an average of 3 moles of ethylene oxide 45E7: A $C_{14-15}$ primary alcohol condensed with an average of 7 moles of ethylene oxide TFAA: $C_{16}$–$C_{18}$ (tallow) polyhydroxy fatty acid amide with the polyhydroxyhydrocarbyl derived from glucose PEG: Polyethylene glycol (MWt normally follows)

TAED: Tetraacetyl ethylene diamine

Silicate: Amorphous Sodium Silicate ($SiO_2$:$Na_2O$ ratio normally follows)

Carbonate: Anhydrous sodium carbonate

CMC: Sodium carboxymethyl cellulose

Zeolite A: Hydrated Sodium Aluminosilicate of formula $Na_{12}(A10_2SiO_2)_{12}.27H_2O$ having a primary particle size in the range from 1 to 10 micrometers Citrate: Tri-sodium citrate dihydrate NaSKS-6 Sodium crystalline layered silicate of the form $Na_2Si_2O_5$ Photoactivated Bleach: Tetra sulfonated Zinc phthalocyanine MA/AA: Copolymer of 1:4 maleic/acrylic acid, average molecular weight about 80,000.

Perborate Monohydrate: Anhydrous sodium perborate bleach empirical formula $NaBO_2.H_2O_2$ Enzyme: Mixed proteolytic and amylolytic enzyme sold by Novo Industries AS.

Optical brightener: Disodium 4,4'-bis(2-morpholino-4-anilino-s-triazin-6-ylamino) stilbene-2:2'-disulphonate.

DETPMP: Diethylene triamine penta (Methylene phosphonic acid), marketed by Monsanto under the Trade name Dequest 2060

Suds Suppressor: 25% paraffin wax Mpt 50° C., 17% hydrophobic silica, 58% paraffin oil Compositions F and G, labelled as 'spray-dried particulate components', were essentially spray dried blown powders, although the 45E7 was sprayed on as a later addition. The bulk density of these two components was approximately 620 g/liter.

Compositions H, I, L and M were particulate agglomerate components with a bulk density in the range 650–670 g/liter.

Compositions J and K consisted of surfactant-containing spray dried particulate and particulate agglomerate components and further ingredients added separately as dry mixed solids or which were sprayed on (45E7, perfume and mixed suds suppressor) to the solid components. In composition J 100% (2.2 parts) of the TAS and 39.7% (0.5 parts) of the 25AE3S together with 63.7% (12.8 parts) of the Zeolite A and the MA/AA, CMC, DETPMP, optical brightener and $MgSO_4$ were incorporated into the blown powder. The 45AS, the remainder of the Zeolite A, 27.7% (4.84 parts) of the carbonate and the remaining 60.3% (0.76 parts) of the 25AE3S were added as a particulate agglomerate. The bulk density of both compositions J and K was approximately 680 g/liter.

The surfactant release test method was used as described hereinbefore. To determine the amount of alkyl and alkyl ethoxysulfate salts in the filtered (0.45 m filter pore size) 5 ml samples when compositions F–K are dissolved according to the surfactant dissolution test method the following titration method was employed:

Initially, a mixed indicator solution was prepared by first dissolving 0.4 g of dimidium bromide and 0.2 g di-sulphine blue in 20 to 30 mls of hot 10% alcohol solution. This hot solution is then transferred to a 200 ml volumetric flask, allowed to cool, and then made up to 200 ml with 10% alcohol solution to give a more dilute solution. A 20 ml portion of this more dilute solution is then transferred to a one liter volumetric flask containing 200 mls de-ionised water to which is added 15 mls of a 25% solution of sulfuric acid and then further de-ionised water to one liter.

A 100 ml flat bottomed glass Nesstler tube is then taken and placed on a sheet of white paper to aid determination of the colour change at the 'end point' of the titration. 20 ml of mixed indicator solution and 15 mls of dichloromethane are placed in the tube together with a 2.5 ml aliquot, measured out using a graduated pipette, of the 5 ml filtered samples obtained as hereinbefore described. The solution is continually stirred using a magnetic stirrer, so that the dichloromethane layer, which is red, is forced to the top of the solution. This solution is then titrated with 0.004M Hyamine 1622 solution until the end-point, characterised by a change in colour of the dichloromethane layer from red to grey/purple, is reached. The amount of alkyl sulfate and alkyl ethoxysulfate salts in the 5 ml filtered samples and hence the percentage of alkyl sulfate and alkyl ethoxysulfate salts dissolved as a percentage of the maximum amount possible were then obtained for each 5 ml sample.

To determine the amount of tallow fatty acid amide (TFAA) in the filtered 5 ml samples when compositions L and M are dissolved according to the surfactant dissolution test method, high pressure liquid chromatography (HPLC) used in reversed phase with UV detection was employed. The use of HPLC as a physical analytical chemistry method is well known. Determination of the levels of TFAA in the 5 ml samples of the surfactant dissolution test method is achieved by comparison to the calibration scale of responses obtained for suitable standard solutions containing known levels of TFAA.

The details of the HPLC method to be used are as follows: A Hypersil SAS (C1) column of dimensions 250 mm×4.6 mm at a column temperature of 50° C. is employed. The flow rate is set at 1.2 ml/min with a run time of 12 minutes and injection volume of 20 l. The eluent is composed of 42% of a 0.02M solution of $NH_4H_2PO4$ in deionised water containing 2.5% acetonitrile and adjusted to pH3 with orthophosphonic acid and 58% acetonitrile (HPLC grade, low UV cutoff). The samples and standards are dissolved to give 60:40, propan-2-ol:water solutions. The standards are chosen to be appropriate to the ranges of TFAA expected in the samples. All solvents employed must be HPLC grade or better and all water used must be de-ionised. All eluents and samples and standards before injection must be filtered to 0.45 m.

Improved dissolution characteristics were obtained for compositions F, H, J and L by comparison to those obtained for compositions G, I, K and M respectively in the surfactant release test method.

The rate of dissolution of spray-dried particulate component F which contain 1.64% 25AE3S, in accord with the present invention, is indicated by the results presented graphically in FIG. 1, to be increased by comparison to that of the similar spray-dried particulate component G which contains no alkyl ethoxysulfate salt.

Figure 2:
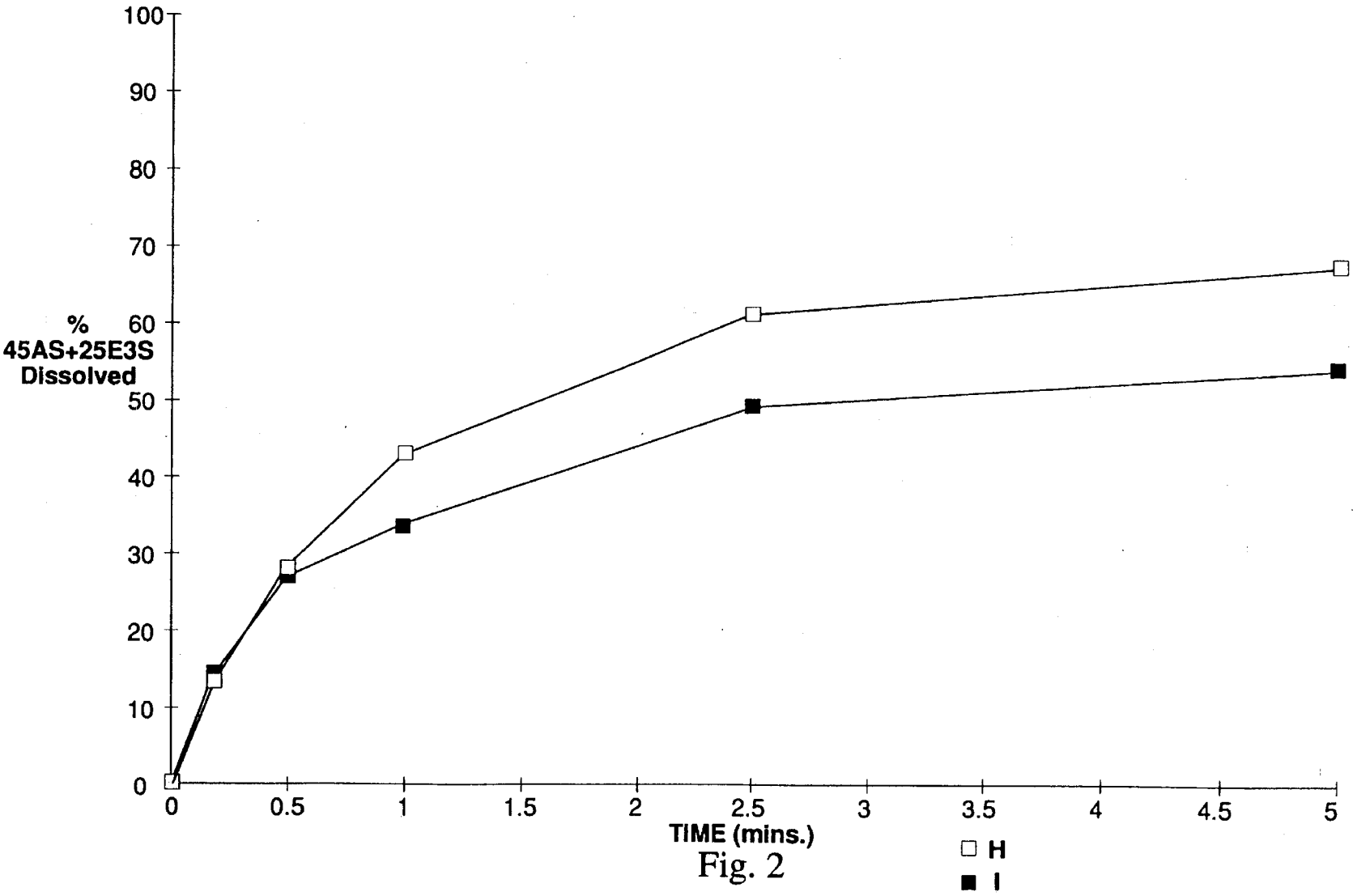

Similarly, the rate of dissolution of particulate agglomerate component H which contains 3.18% 25AE3S, in accord with the present invention, is indicated by the results presented graphically in FIG. 2, to be increased by comparison to that of the similar particulate agglomerate component I which contains no alkyl ethoxysulfate.

Figure 3:
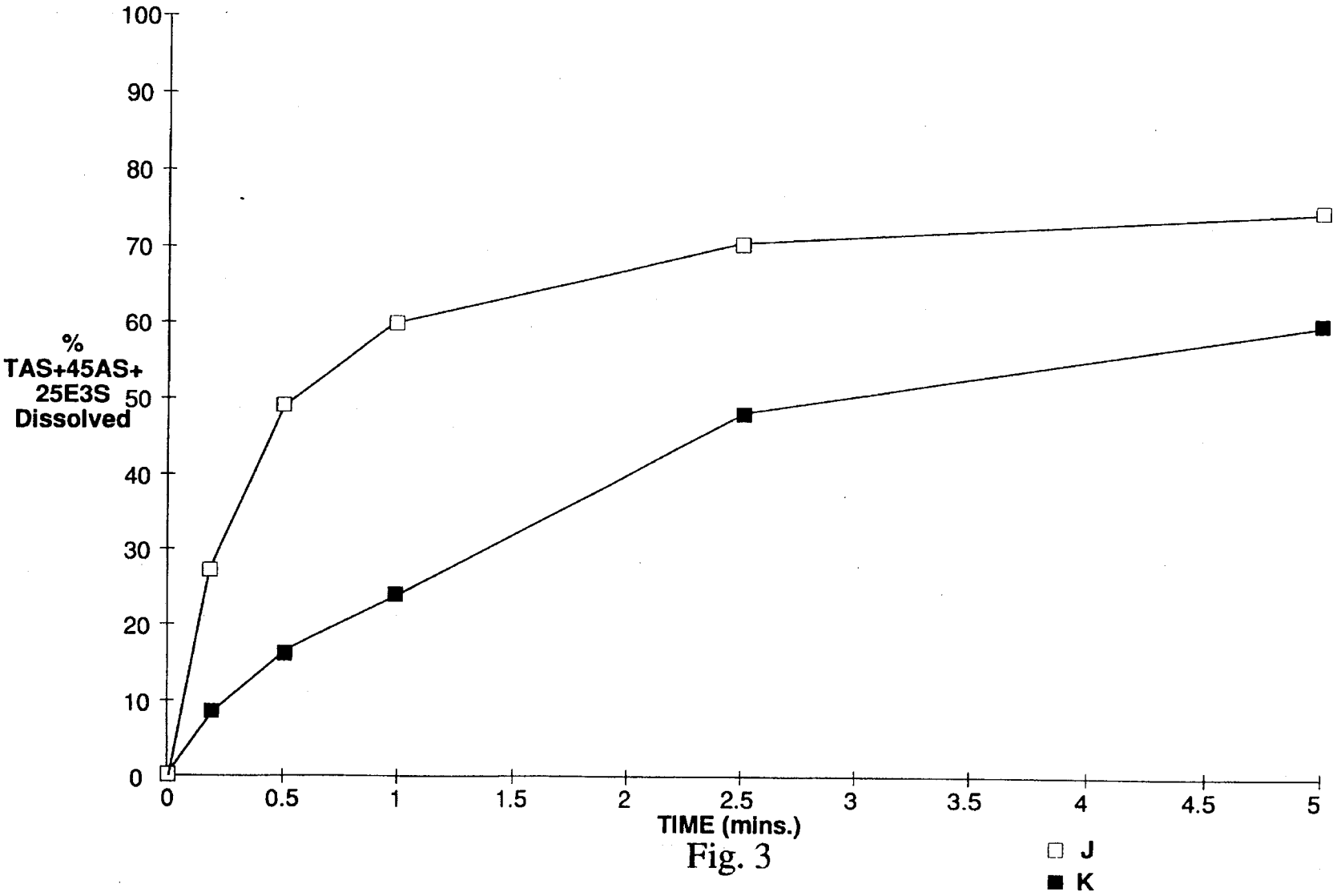
Figure 4:
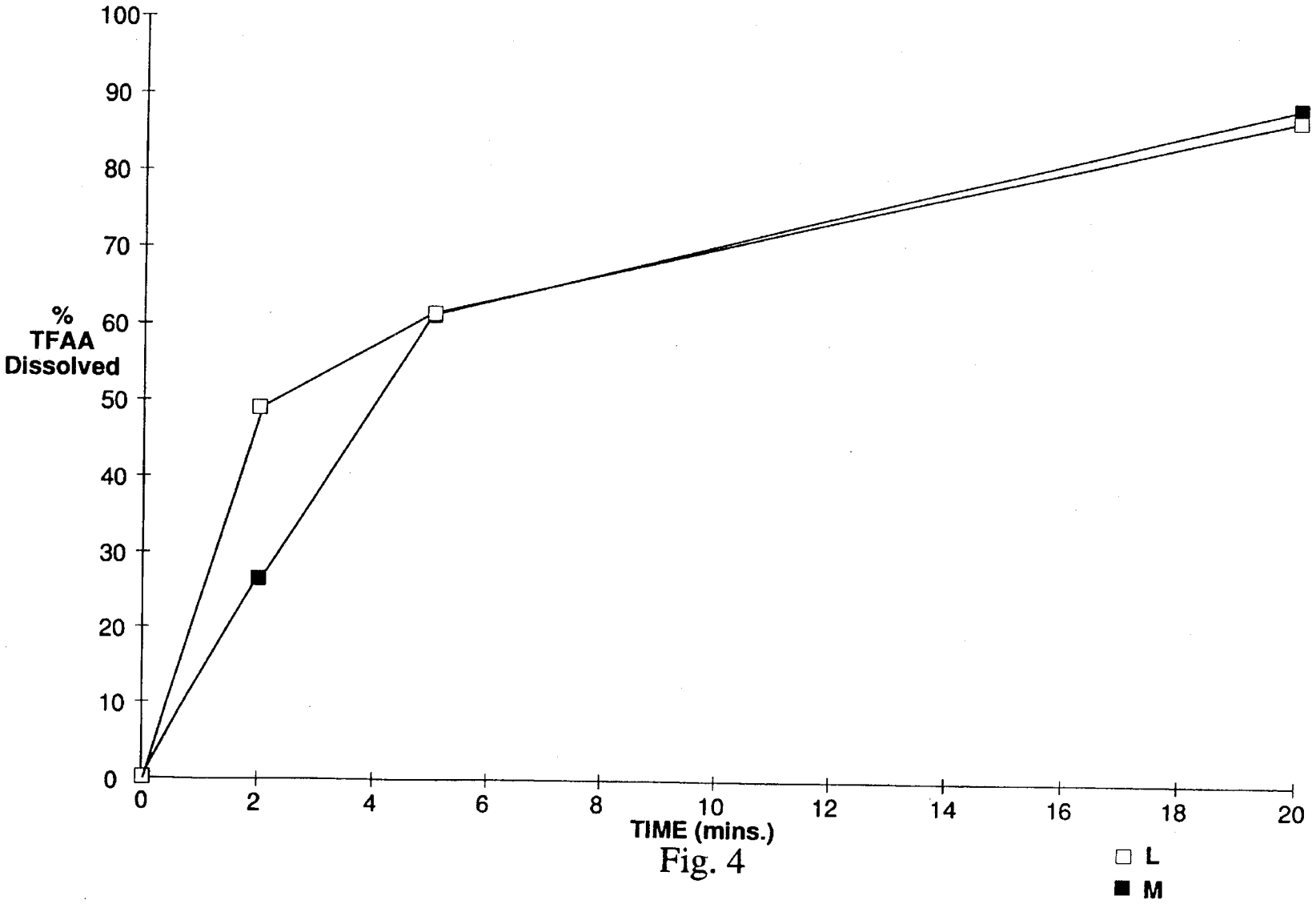

The results presented graphically in FIG. 3 indicate the improved rate of dissolution of composition J which contains 1.26% 25AE3S in accord with the present invention over composition K which contains no alkyl ethoxysulfate.

Composition L differs from composition M in that it contains a much higher content of surfactant overall, and in particular higher amounts of hydrophobic TFAA and 45AS surfactants, together with 25AE3S. Composition M contains no alkyl ethoxysulfate salt. The results presented graphically in FIG. 4 indicate that although the proportion of largely hydrophobic surfactant in composition L is substantially higher than that of composition M the rate of dissolution of composition L in the first five minutes is greater due to the solubilising effect of the 25AE3S in accord with the present invention.

To further illustrate the improved rate of dissolution characteristics of the compositions containing alkyl ethoxysulfate salts values for the 'initial rate of dissolution benefits' for the four pairs of compositions, namely F/G, H/I, J/K and L/M are now given. These 'initial rate of dissolution benefits' were obtained using the method as hereinbefore described and the data as presented graphically in FIGS. 1, 2, 3 and 4 respectively with the required areas under the graphs obtained using the trapezium rule.

| Pairs of Compositions | 'Initial Rate of Dissolution Benefit' |
|---|---|
| F/G | 1.46 |
| H/I | 1.19 |
| J/K | 1.74 |
| L/M | 1.35 |

EXAMPLE 2

The following detergent compositions were prepared (parts by weight). Compositions A and B are prior art compositions and compositions C and D are in accordance with the invention.

| | A | B | C | D |
|---|---|---|---|---|
| LAS | 7.6 | 6.5 | — | — |
| TAS | 2.4 | — | — | — |
| 45AS | — | — | 4.8 | 6.8 |
| 25AE3S | — | — | 1.2 | 1.7 |
| TAE11 | 1.10 | — | — | — |
| TAE50 | — | 0.4 | 0.4 | 0.4 |
| 45E7 | 3.26 | — | — | — |
| 25E3 | — | 5.0 | 5.0 | 5.0 |
| Zeolite A | 19.5 | 13.0 | 13.0 | 13.0 |
| Citrate | 6.5 | — | — | — |
| MA/AA | 4.25 | 4.25 | 4.25 | 4.25 |
| NaSKS-6* | — | 10.01 | 10.01 | 10.01 |
| Citric Acid* | 2.73 | 2.73 | 2.73 | |
| TAE-50* | — | 0.26 | 0.26 | 0.26 |
| Carbonate | 11.14 | 9.84 | 9.84 | 9.84 |
| Perborate | 16.0 | 16.0 | 16.0 | 16.0 |
| TAED | 5.0 | 5.0 | 5.0 | 5.0 |
| CMC | 0.48 | 0.48 | 0.48 | 0.48 |
| Suds Suppressor | 0.5 | 0.5 | 0.5 | 0.5 |
| Brightener | 0.24 | 0.24 | 0.24 | 0.24 |
| Photoactivated bleach | 0.002 | 0.002 | 0.002 | 0.002 |
| Enzyme | 1.4 | 1.4 | 1.4 | 1.4 |
| Silicate (2.0 ratio) | 4.38 | — | — | — |
| MgSO4 | 0.43 | 0.43 | 0.43 | 0.43 |
| Perfume | 0.43 | 0.43 | 0.43 | 0.43 |
| Sulphate | 4.10 | 11.67 | 11.67 | 11.67 |
| DETPMP | — | 0.38 | 0.38 | 0.38 |
| Water and miscellaneous to balance | | | | |

*Present as components of crystalline layered silicate particulates.

The performance of the four compositions was compared in full scale single cycle and six-cycle washing machine tests using Miele 701 washing machines. The test wash cycle comprised only a main wash cycle. A temperature setting of 60° C. was selected for each wash cycle and water of 25° C. German Hardness (Ca:Mg=3:1) was employed.

Clean, softened sets of fabric swatches were prepared by washing one 15 cm×40 cm swatch of each of clean white terry towel, vest, cotton and polycotton fabrics eight times in the presence of a clean fabric ballast load. Composition A was used as the detergent product at a dosage of 100 g, and 110 ml of a liquid commercial cationic fabric softener comprising about 20% by weight of cationic fabric softening component (a quaternary ammonium imidazolinum) compound was added to the final rinse of each wash cycle.

Each test laundry load comprised a set of the four softened swatches together with a ballast load of 3 Kg of moderately soiled fabrics. For each test wash-cycle the laundry load together with a dispensing device of the "granulette" type containing 100 g of the detergent product was placed in the drum of the washing machine. Commercial cationic fabric softener of the same type as described above, at a dosage of 110 ml, was added to the final rinse cycle of each test wash cycle.

At the end of the first cycle (single cycle test) or sixth cycle (six-cycle test) the laundry load was removed from the machine, dried and then an assessment of the whiteness and yellowness of each of the sets of fabric swatches was made.

Whiteness/Yellowness

The whiteness of each set of fabric swatches was initially assessed by an expert panel using a five point Scheffé scale. The combined averaged results of each of the sets of comparisons are as set out below, with prior art composition A being used as the common reference.

| Panel-Score Comparison | B/A | C/A | D/A |
|---|---|---|---|
| Single cycle | −1.3 s | +0.6 | −0.6 |
| Six-cycle | −1.0 s | +0.2 | +0.2 |

Whiteness and yellowness indices were then obtained using a Macbeth Color Eye 3000 spectrophotometer (supplied by Spectrum International), and comparison made with the reference (Composition A). The yellowness indices were calculated according to equations set out in ASTM D 1925 (Billmeyer) and the whiteness indices calculated as CIE formulas.

| | B/A | C/A | D/A |
|---|---|---|---|
| Whiteness | | | |
| Single cycle | −1.0 | 0.0 | −0.7 |
| Six-cycle | −1.9 | +1.0 | +0.4 |
| Yellowness | | | |
| Single cycle | −0.7 | −0.1 | −0.5 |
| Six-cycle | −0.7 | +0.1 | 0.0 |

s = statistically significant at the 95% confidence level.

The whiteness/yellowness comparisons show that Composition B comprising 6.5% LAS as the only anionic surfactant provides poor yellowness and whiteness results in the presence of cationic fabric softener by comparison with the prior art reference A, which has a total anionic surfactant level of 10.14%. Compositions C and D which are in accord with the invention comprise total anionic surfactant levels of 6% and 8.5% respectively, but provide good whiteness/yellowness results in the presence of cationic fabric softener by comparison with the prior art reference A.

We claim:

1. A particulate composition which is essentially free of alkylbenzene sulfonate and comprises:

(a) from 5 to 60% by weight of a primary anionic or nonionic surfactant selected from the group consisting of;

(1) a $C_{14}$–$C_{20}$ alkyl sulfate salt;

(2) an aliphatic $C_{12}$–$C_{20}$ alkane sulfonate salt;

(3) a $C_{12}$–$C_{20}$ alkyl methyl ester sulfonate salt;

(4) a polyhydroxy fatty acid amide having the formula $$R^6-\overset{\overset{\displaystyle O}{\|}}{C}-\overset{\overset{\displaystyle R^5}{|}}{N}-Z$$

where $R^5$ is H, $C_1$–$C_4$ hydrocarbyl, 2 hydroxyethyl, 2 hydroxypropyl or a mixture thereof, $R^6$ is $C_{11}$–$C_{31}$ hydrocarbyl and Z is a polyhydroxhydrocarbyl having a linear hydrocarbon chain with at least three hydroxy groups directly connected to said chain or an alkyloxylated derivative thereof; and (5) mixtures of any of the foregoing;

(b) 0.25–5.0% of a water soluable $C_{11}$–$C_{18}$ alkyl ethyoxysulfate salt containing an average of from 1 to 7 ethoxy groups per mole;

(c) from 15 to 95% by weight of an organic and/or inorganic builder salt or a mixture of such salts; and wherein components (a) and (b) are in intimate admixture and the weight ratio of (a):(b) is between 2:1 to 19:1, wherein said particulate composition is admixed in a detergent composition having density greater than 550 grams per liter, and wherein the total weight of (a) and (b) constitutes 5 to 10% by weight of the detergent composition.

2. A particulate composition which is essentially free of alkylbenzene sulfonate and comprises:

(a) from 5 to 60% by weight of a primary anionic or nonionic surfactant selected from the group consisting of;

(1) a $C_{14}$–$C_{20}$ alkyl sulfate salt;

(2) a $C_{12}$–$C_{20}$ alkyl methyl ester sulfonate salt;

(3) a polyhydroxy fatty acid amide having the formula $$R^6-\overset{\overset{\displaystyle O}{\|}}{C}-\overset{\overset{\displaystyle R^5}{|}}{N}-Z$$

where $R^5$ is H, $C_1$–$C_4$ hydrocarbyl, 2 hydroxyethyl, 2 hydroxypropyl or a mixture thereof, $R^6$ is $C_{11}$–$C_{31}$ hydrocarbyl and Z is a polyhydroxhydrocarbyl having a linear hydrocarbon chain with at least three hydroxy groups directly connected to said chain or an alkyloxylated derivative thereof; and (4) mixtures of any of the foregoing;

(b) 0.25–5.0% of a water soluable $C_{11}$–$C_{18}$ alkyl ethyoxysulfate salt containing an average of from 1 to 7 ethoxy groups per mole;

(c) from 15 to 95% by weight of an organic and/or inorganic builder salt or a mixture of such salts; and wherein components (a) and (b) are in intimate admixture and the weight ratio of (a):(b) is between 2:1 to 19:1, wherein said particulate composition is admixed in a detergent composition having density greater than 550 grams per liter, and wherein the total weight of (a) and (b) constitutes 5 to 10% by weight of the detergent composition.

3. A particulates composition according to claim 1 wherein surfactant (4) is a polyhydroxy fatty acid amide of formula $$R^6-\overset{\overset{\displaystyle O}{\|}}{C}-\overset{\overset{\displaystyle R^5}{|}}{N}-CH_2(CHOH)_4CH_2OH$$

wherein $R^6$ is a $C_{11}$–$C_{19}$ straight chain alkyl or alkenyl group and $R^5$ is methyl.

4. A particulate composition according to claim 1 wherein the alkyl ethoxysulfate salt is present at levels of from 0.5% to 5% by weight of said particulate composition.

5. A particulate composition according to claim 1 wherein the alkyl sulfate salt comprises $C_{16}$–$C_{20}$ alkyl sulfate salt.

6. A particulate composition according to claim 1 wherein the alkyl sulfate salt comprises a substantially branched $C_{14}$–$C_{15}$ alkyl sulfate salt.

7. A particulate composition according to claim 1 wherein said particulate composition comprises from 15% to 60% by weight of (a) and, from 20% to 85% by weight of organic and or inorganic builder salts (c).

8. A granular detergent composition comprising from 2% to 9% additional nonionic surfactant by weight along with the particulate composition of claim 1.

9. A granular detergent composition according to claim 8 wherein said additional nonionic surfactant is a $C_{12}$–$C_{20}$ ethoxylated alcohol containing an average of from three to eleven ethoxy groups per mole.

10. A granular detergent composition according to claim 9 wherein said additional nonionic surfactant is a $C_{12}$–$C_{15}$ ethoxylated alcohol containing an average of from three to seven, most preferably an average of three ethoxy groups per mole.

11. A particulate composition according to claim 1 wherein said alkyl ethoxysulfate salt comprises a $C_{12}$–$C_{15}$ alkyl sulfate condensed preferably with an average from one to five, most preferably an average of from one to three, ethoxy groups per mole.

12. A particulate composition according to claim 1 wherein said organic and/or inorganic builder salt comprises a mixture of non phosphate builder salts.

13. A particulate composition according to claim 12 wherein said mixture of builder salts is selected from crystalline sodium aluminosilicates zeolites of type A, X or HS, alkali metal carbonates and alkali metal polycarboxylates, alkali metal or alkaline earth metal alkylene amino polymethylene phosphonates and alkali metal salts of homo- or copolymeric polycarboxylic acids in which the polycarboxylic acid comprises at least two carboxylic radicals separated from each other by not more than two carbon atoms.

14. A granular detergent composition comprising the particulate composition of claim 1 and additional particulate components selected from oxygen bleaches, bleach activators, photo activated bleaches, citrates, amorphous silicates, other builder salts, detergent enzymes, soil suspension and antiredeposition agents, optical brighteners, suds suppressors and mixtures thereof.

* * * * *